US007364489B1

(12) United States Patent
Iaconis et al.

(10) Patent No.: US 7,364,489 B1
(45) Date of Patent: Apr. 29, 2008

(54) ELECTROMECHANICAL TOY

(75) Inventors: Michael J. Iaconis, Wrentham, MA (US); Jeffrey M. Ford, Warwick, RI (US); Leif J. Askeland, Cranston, RI (US); Peter Hall, Norfolk (GB); Richard Maddocks, Barrington, RI (US)

(73) Assignee: Hasbro, Inc., Pawtucket, RI (US)

( * ) Notice: Subject to any disclaimer, the term of this patent is extended or adjusted under 35 U.S.C. 154(b) by 138 days.

(21) Appl. No.: 10/698,930

(22) Filed: Nov. 3, 2003

Related U.S. Application Data

(63) Continuation-in-part of application No. 10/425,992, filed on Apr. 30, 2003, now Pat. No. 6,843,703.

(51) Int. Cl.
*A63H 3/20* (2006.01)
*A63H 11/00* (2006.01)
*A63H 13/00* (2006.01)
*A63H 3/46* (2006.01)

(52) U.S. Cl. ..... 446/330; 446/353; 446/376

(58) Field of Classification Search ..... 446/175, 446/268, 297, 298, 300, 330, 338, 371, 372, 446/369, 376, 377, 384, 391, 352, 353, 356
See application file for complete search history.

(56) References Cited

U.S. PATENT DOCUMENTS 112,550 A 3/1871 Clay
1,345,052 A 6/1920 Williams
1,574,035 A 2/1926 Holtzman
1,601,983 A 10/1926 Savage
1,639,442 A 8/1927 Strauss et al.
1,782,477 A * 11/1930 Price ..... 446/356
1,891,816 A 12/1932 Hewitt
1,992,477 A 2/1935 Domowitch et al.
2,158,860 A 5/1939 Hyde
2,194,537 A 4/1940 Adams
2,232,615 A 2/1941 Kupka
2,421,279 A 5/1947 Marty
2,596,216 A 5/1952 Dawson
2,606,022 A 8/1952 Vander Veer et al.
2,614,365 A 10/1952 White et al.

(Continued)

FOREIGN PATENT DOCUMENTS

DE 19755465 A1 12/1997

(Continued)

OTHER PUBLICATIONS

U.S. Appl. No. 10/667,977, filed Sep. 23, 2003.

(Continued)

*Primary Examiner*—Eugene Kim
*Assistant Examiner*—Alyssa M Hylinski
(74) *Attorney, Agent, or Firm*—Fish & Richardson P.C.

(57) ABSTRACT

A toy includes a body, a motor within the body, an appendage coupled to the body of the toy, a tail device coupled to the body of the toy, and a neck device coupled to the body of the toy. The appendage is actuated by the motor to move along a first path. The tail device is actuated by the motor to move along a second path. The neck device is actuated by the motor to move along a third path.

47 Claims, 18 Drawing Sheets

U.S. PATENT DOCUMENTS 2,620,594 A 12/1952 Parisi
2,641,865 A 6/1953 Gowland
2,738,617 A 3/1956 Capehart
2,782,032 A 2/1957 Plympton
2,800,323 A 7/1957 West et al.
2,801,104 A 7/1957 Yetter
2,910,799 A 11/1959 Wentworth
3,153,871 A * 10/1964 Semba ..... 40/416
3,163,960 A 1/1965 Iwaya et al.
3,164,924 A * 1/1965 Iwaya et al. ..... 446/143
3,181,270 A 5/1965 Trevena
3,199,248 A * 8/1965 Suzuki ..... 446/299
3,266,059 A 8/1966 Stelle
3,395,483 A 8/1968 Mullins
3,443,338 A * 5/1969 Collins ..... 446/301
3,484,988 A 12/1969 Robbins
3,490,172 A 1/1970 Schwartz
3,568,363 A 3/1971 Tanimura
3,705,387 A 12/1972 Stern et al.
3,940,879 A 3/1976 Glass et al.
3,981,098 A 9/1976 Darda
4,086,724 A 5/1978 McCaslin
4,109,913 A 8/1978 Nielsen
4,125,261 A 11/1978 Lahr
4,143,484 A 3/1979 Yonezawa
4,155,197 A 5/1979 Beny et al.
4,165,581 A 8/1979 Wolf
4,224,759 A 9/1980 Saint-Pierre et al.
4,231,183 A 11/1980 Lahr
4,245,515 A 1/1981 Iwaya
4,248,012 A 2/1981 Kirby et al.
4,276,717 A 7/1981 Zbriger et al.
4,333,261 A 6/1982 Jones et al.
4,363,187 A 12/1982 Shinohara
4,389,811 A * 6/1983 Iwaya et al. ..... 446/193
4,453,712 A 6/1984 Lee
4,479,327 A 10/1984 Wakimura
4,494,417 A 1/1985 Larson et al.
4,516,951 A 5/1985 Saigo et al.
4,540,176 A 9/1985 Baer
4,571,208 A 2/1986 Saigo et al.
4,573,941 A 3/1986 Holden et al.
4,595,381 A 6/1986 Dibold et al.
4,601,671 A 7/1986 DeMars
4,636,177 A 1/1987 Koguchi
4,655,724 A 4/1987 Law
4,662,854 A 5/1987 Fang
4,671,779 A 6/1987 Kurosawa
4,673,371 A 6/1987 Furukawa
4,680,022 A 7/1987 Hoshino et al.
4,708,688 A 11/1987 Lee
4,717,364 A 1/1988 Furukawa
4,775,351 A 10/1988 Provenzano, Jr.
4,795,395 A 1/1989 Oishi et al.
4,798,553 A 1/1989 Gentles et al.
4,802,878 A 2/1989 Terzian et al.
4,810,226 A * 3/1989 Takahashi et al. ..... 446/300
4,815,911 A 3/1989 Bengtsson et al.
4,820,232 A * 4/1989 Takahashi et al. ..... 446/178
4,822,285 A 4/1989 Summerville
4,828,525 A 5/1989 Okano
4,846,756 A 7/1989 Hesse
4,878,875 A * 11/1989 Pin-Hung et al. ..... 446/356
4,909,770 A 3/1990 Hesse
4,913,676 A * 4/1990 Koguchi et al. ..... 446/300
4,923,428 A 5/1990 Curran
4,944,708 A 7/1990 Kawabe
4,968,280 A 11/1990 Kelley
5,011,449 A 4/1991 Handy et al.
5,030,160 A 7/1991 Klawitter
5,056,249 A 10/1991 Sakurai
5,080,681 A 1/1992 Erb
5,080,682 A 1/1992 Schectman
5,094,645 A * 3/1992 Stern et al. ..... 446/370
5,141,464 A 8/1992 Stern et al.
5,158,492 A 10/1992 Rudell et al.
5,195,920 A 3/1993 Collier
5,267,886 A 12/1993 Wood et al.
5,295,893 A 3/1994 Chiu
5,297,443 A 3/1994 Wentz
5,306,199 A 4/1994 Locricchio
5,316,516 A * 5/1994 Saitoh ..... 446/175
5,324,225 A * 6/1994 Satoh et al. ..... 446/175
5,374,216 A * 12/1994 Jung et al. ..... 446/175
5,378,188 A 1/1995 Clark
5,409,447 A 4/1995 Wedge, Jr.
5,498,193 A 3/1996 Locricchio
5,505,493 A 4/1996 Camfield et al.
5,647,787 A 7/1997 Raviv et al.
5,697,829 A 12/1997 Chainani et al.
5,724,074 A 3/1998 Chainani et al.
5,846,115 A 12/1998 Feng
5,876,263 A * 3/1999 DeCesare et al. ..... 446/330
5,908,345 A 6/1999 Choi
5,931,715 A 8/1999 Chang
5,941,755 A 8/1999 Danielian
6,053,797 A 4/2000 Tsang et al.
6,059,666 A 5/2000 Ohara et al.
6,083,104 A 7/2000 Choi
6,089,948 A 7/2000 LaBarbara, Jr. et al.
6,139,394 A 10/2000 Maxim
6,142,851 A 11/2000 Lewinski et al.
6,149,490 A 11/2000 Hampton et al.
6,160,986 A 12/2000 Gabai et al.
6,200,190 B1 3/2001 Reynolds
6,200,193 B1 3/2001 Nadel
6,210,167 B1 4/2001 Nishiyama
6,250,987 B1 6/2001 Choi
6,253,058 B1 6/2001 Murasaki et al.
6,273,782 B1 * 8/2001 Chan et al. ..... 446/356
6,322,420 B1 11/2001 Daniellian
6,350,170 B1 2/2002 Liu
6,371,826 B1 4/2002 Pestonji
6,386,943 B1 * 5/2002 Chang ..... 446/354
6,390,883 B1 5/2002 Choi
6,402,153 B1 6/2002 Stewart
6,435,936 B1 8/2002 Rehkemper et al.
6,458,010 B1 10/2002 Yamagishi et al.
6,461,218 B1 10/2002 Mullaney et al.
6,471,565 B2 10/2002 Simeray
6,497,607 B1 12/2002 Hampton et al.
6,514,117 B1 2/2003 Hampton et al.
6,546,663 B1 4/2003 Signitzer et al.
6,565,407 B1 5/2003 Woolington et al.
6,602,106 B2 8/2003 Cheung
6,652,353 B1 11/2003 Lund et al.
6,661,239 B1 12/2003 Ozick
6,666,744 B2 12/2003 Llorens
6,672,934 B2 * 1/2004 Hornsby et al. ..... 446/300
6,695,672 B1 2/2004 Rehkemper et al.
6,695,673 B1 * 2/2004 Stadbauer ..... 446/305
6,699,098 B1 3/2004 Kau
6,769,954 B2 * 8/2004 Su ..... 446/353
6,940,291 B1 9/2005 Ozick
2001/0029147 A1 * 10/2001 Hornsby et al. ..... 446/356
2004/0152394 A1 8/2004 Marine et al.

FOREIGN PATENT DOCUMENTS

EP 641580 A1 3/1995
GB 2221401 A 2/1990
GB 2222959 A 3/1990
JP 11-207042 8/1999

JP 2001-300149 10/2001

OTHER PUBLICATIONS

U.S. Appl. No. 10/425,992, filed Apr. 30, 2003.
U.S. Appl. No. 10/305,265, filed Nov. 27, 2002.
The Wow Wee horse, a toy horse produced by WowWee in 2002 and shown at Toy Fair in Feb. 2003 in NY, NY, 3 pages of photographs.
The Hasbro dog, a toy dog produced and sold by Hasbro in the U.S. before the year 2000, 3 pages of photographs.

* cited by examiner

ELECTROMECHANICAL TOY

CROSS-REFERENCE TO RELATED APPLICATIONS

This application claims priority from and is a continuation-in-part of U.S. application Ser. No. 10/425,992, filed Apr. 30, 2003 now U.S. Pat. No. 6,843,703, titled "Electromechanical Toy," which is incorporated herein by reference.

TECHNICAL FIELD

This description relates to an electromechanical toy.

BACKGROUND

Toys that have moving parts are well known. For example, dolls and plush toys such as stuffed animals are made with moveable appendages.

SUMMARY

A toy may be configured to closely resemble a live animal and to respond to stimuli in a realistic manner that is consistent with the way in which a real animal would respond. For example, when the toy is designed to resemble a puppy or a kitten, the toy may be configured to move in a manner consistent with the movements of a puppy or a kitten. This realistic movement, in conjunction with a realistic fur coat coupled to and covering inner mechanical components, may be used to provide a strikingly realistic toy.

For example, the toy animal may wag its tail as it sits up or down. The toy animal may raise its head as it sits up and lower its head as it sits down. The fur coat may be made of pile that resembles an animal's coat. The fur coat may move with the arm or paw of the toy animal.

In one general aspect, a toy includes a body, a motor within the body, an appendage coupled to the body of the toy, a tail device coupled to the body of the toy, and a neck device coupled to the body of the toy. The appendage is actuated by the motor to move along a first path. The tail device is actuated by the motor to move along a second path. The neck device is actuated by the motor to move along a third path.

Implementations may include one or more of the following features. For example, movement of the neck device, the tail device, and the appendage may occur simultaneously.

The toy may include a drive shaft that couples the motor to the appendage. The toy may also include a cam that receives the drive shaft such that rotation of the drive shaft rotates the cam. The toy may include an eccentric rod to which the appendage connects. The eccentric rod extends from the cam.

The toy may include a pivot gear coupled to the body of the toy and including a post that couples to a slot within the appendage. The toy may include gear teeth that extend from the cam and that mesh with gear teeth of the pivot gear such that rotation of the cam causes rotation of the pivot gear, which causes the appendage to move along the first path.

The toy may include a linkage rod coupled to the body of the toy and to a slot within the appendage. Rotation of the cam causes the appendage to move along the first path.

The drive shaft may couple the motor to the tail device. The toy may further include a cam that receives the drive shaft such that rotation of the drive shaft rotates the cam. The toy may include a connector piece within the body that connects to the tail device and couples to the cam such that rotation of the cam oscillates the connector piece. The cam may define a groove that receives a shaft of the connector piece. The connector piece may connect to a lower piece of the tail device to cause the tail device to oscillate about a tail axis as the connector piece oscillates due to rotation of the cam. The second path of movement may have the appearance of a wagging tail.

The drive shaft may couple the motor to the neck device. The toy may include a head connected to the neck device. The neck device may include a hinge attached to the body such that the neck device is configured to rotate about the hinge as the neck device moves along the third path. The toy may include a follower attached to the neck device and coupled to the drive shaft such that rotation of the drive shaft moves the follower in a periodic pattern and causes the neck device to move along the third path.

The toy may include a controller within the body and coupled to the motor, and a sensor connected to send a signal to the controller. The controller causes the motor to operate in response to a signal from the sensor.

The toy may include another appendage shaped like the appendage and coupled to the body of the toy. Each of the appendages may be positioned such that ends of the appendages move in non-circular paths that are aligned with each other.

Movement along the first path may include movement of an end of the appendage along a non-circular path.

The toy may also include a flexible skin surrounding the body of the toy. The flexible skin may include pile that resembles an animal's coat. The flexible skin may surround the appendage of the toy and may move as the appendage moves.

In another general aspect, a toy includes a body, a motor within the body, a first extension coupled to the body of the toy, a second extension coupled to the body of the toy, and a third extension coupled to the body of the toy. The first extension is actuated by the motor to rotate about a first axis, the second extension is actuated by the motor to rotate about a second axis that is perpendicular with the first axis, and the third extension is actuated by the motor to rotate about a third axis that is parallel with the first axis.

Implementations may include one or more of the following features. For example, the rotation of the first, second, and third extensions may occur simultaneously. The toy may include a drive shaft that couples the motor to the first extension. The toy may include a cam that receives the drive shaft such that rotation of the drive shaft rotates the cam. The cam may include an eccentric rod to which the first extension connects. The drive shaft may couple the motor to the second extension. The toy may include a cam that receives the drive shaft such that rotation of the drive shaft rotates the cam.

The toy may include a connector piece within the body that connects to the second extension and couples to the cam such that rotation of the cam oscillates the connector piece. The cam may define a groove that receives a shaft of the connector piece. The connector piece may connect to a lower piece of the second extension to cause the second extension to oscillate about the second axis as the connector piece oscillates due to rotation of the cam.

The drive shaft may couple the motor to the third extension. The third extension may include a hinge attached to the body defining the third axis. The toy may include a follower attached to the third extension and coupled to the drive shaft such that rotation of the drive shaft moves the follower in a periodic pattern and causes the third extension to rotate about the third axis.

Rotation of the first extension about the first axis may cause movement of an end of the first extension along a non-circular path.

In another general aspect, a toy includes a body, a driving device within the body, a first extension, and a second extension. The driving device includes a drive shaft driven by a motor. The first extension is coupled to a rotating device positioned on the drive shaft to rotate about a first axis. The second extension is coupled to the rotating device positioned on the drive shaft to rotate about a second axis that is perpendicular to the first axis.

Implementations may include one or more of the following features. For example, the toy may include a third extension coupled to a second rotating device positioned on the drive shaft to rotate about a third axis that is parallel with the first axis. The rotation of the first and second extensions may occur simultaneously. The first extension may couple to an eccentric rod on a first surface of the rotating device.

The toy may also include a connector piece within the body that connects to the second extension and couples to the rotating device such that the connector piece oscillates as the rotating device rotates. The rotating device may define a groove on a second surface of the rotating device, with the groove receiving a shaft of the connector piece. The connector piece may connect to a lower piece of the second extension to cause the second extension to oscillate about the second axis as the connector piece oscillates due to rotation of the rotating device. The rotation of the second extension may have the appearance of a wagging tail.

In one implementation, the first extension is an appendage, the second extension is a tail device, and the third extension is a neck device.

Other features will be apparent from the description, the drawings, and the claims.

DESCRIPTION OF DRAWINGS

Like reference symbols in the various drawings indicate like elements.

DETAILED DESCRIPTION

Figure 1:
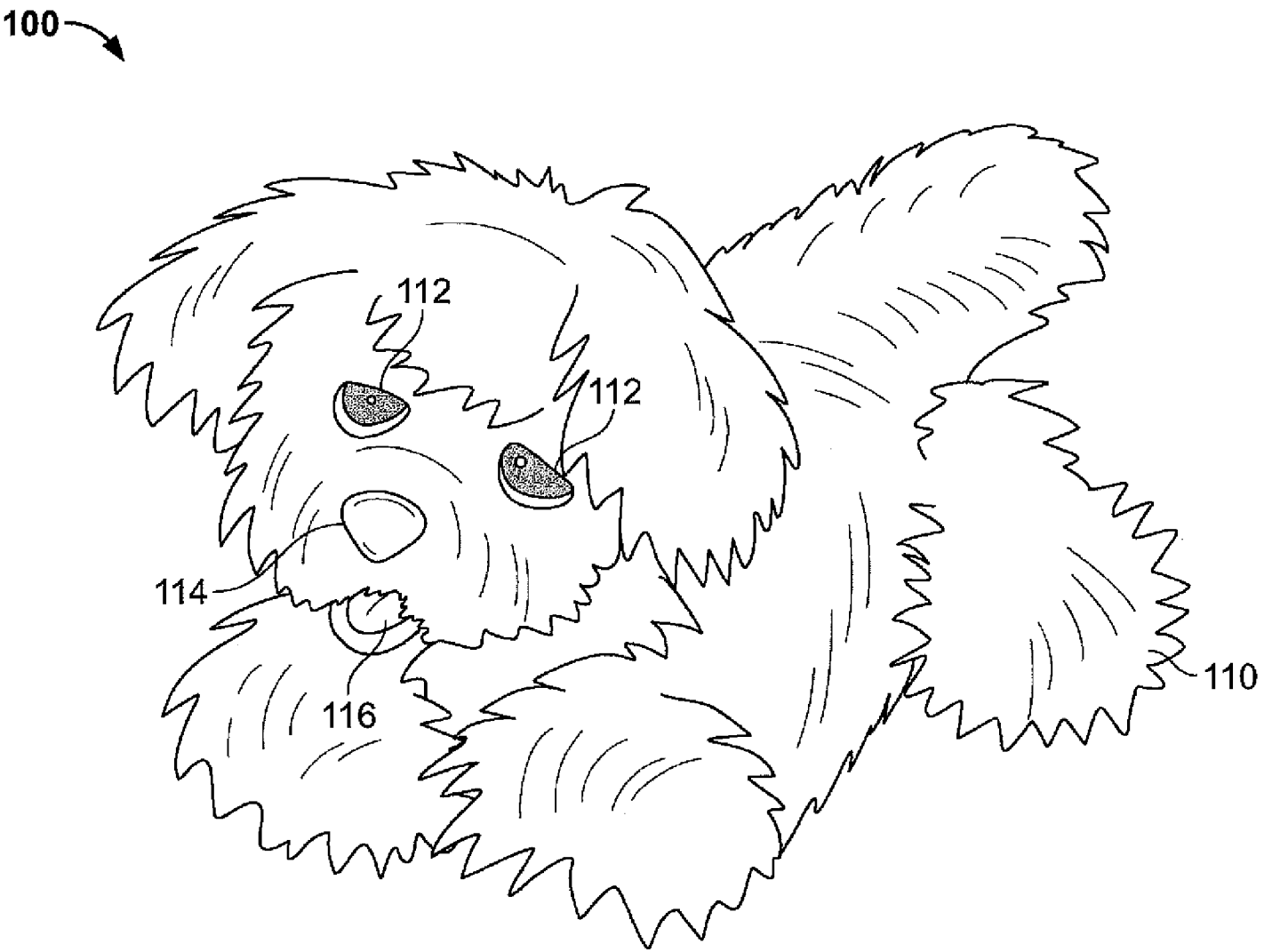
FIG. 1 is a perspective view of a toy.

Referring to FIG. 1, a toy 100 is designed to provide realistic movement in response to a sensed condition. To this end, the toy 100 includes an external flexible skin 110. The external flexible skin 110 may be made of a resilient material that is covered with one or more external soft layers, such as pile that resembles an animal's coat. As shown, the toy 100 is in the shape of a puppy and the external flexible skin 110 resembles the coat of a puppy. The external flexible skin 110 has openings 112, an opening 114, and an opening 116 formed into the skin to facilitate the fitting of the external flexible skin 110 over an internal structure 200, as shown in FIGS. 2A and 2B.

Figure 2A:
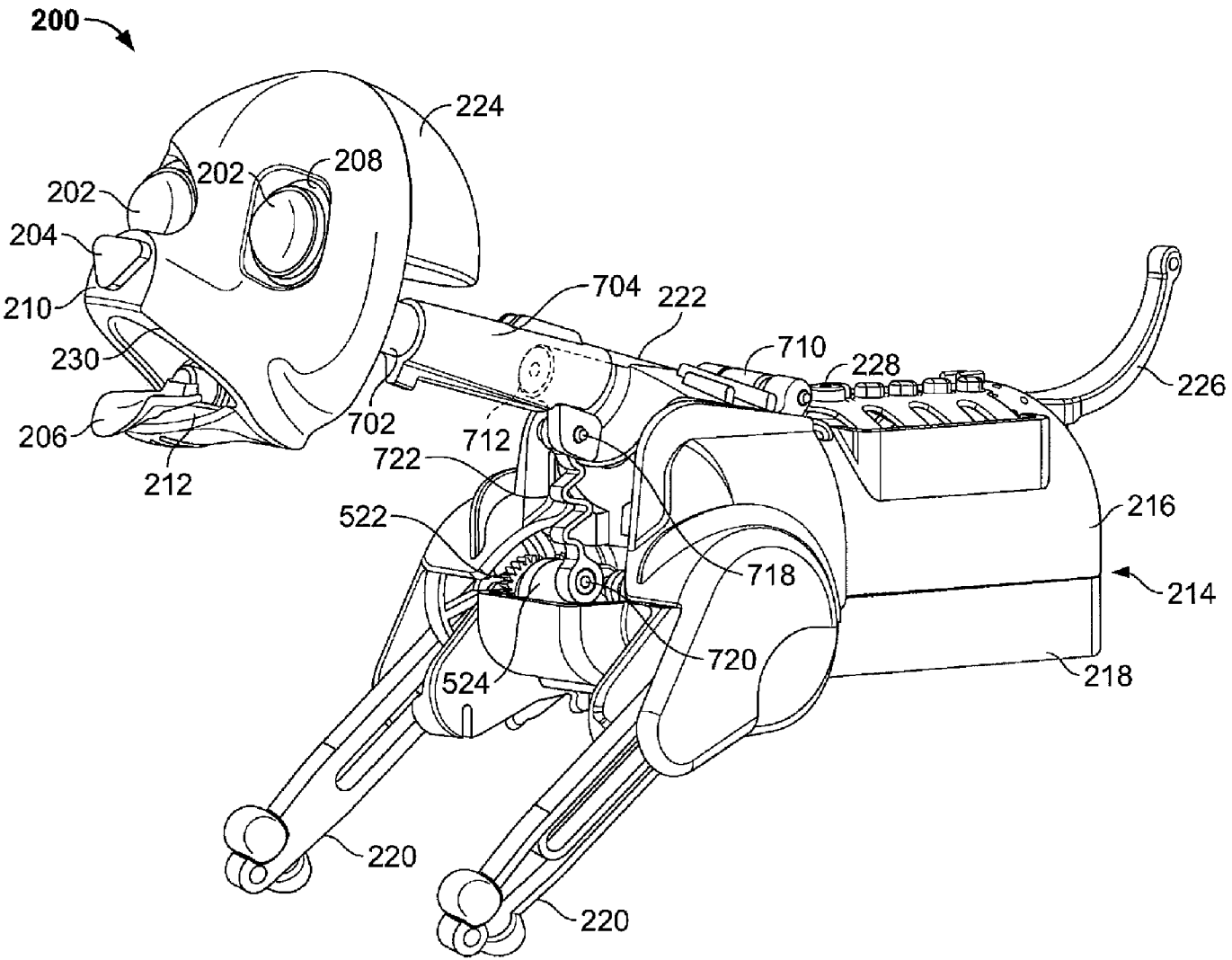
FIG. 2A is a perspective view of an internal structure of the toy of FIG. 1.
Figure 2B:
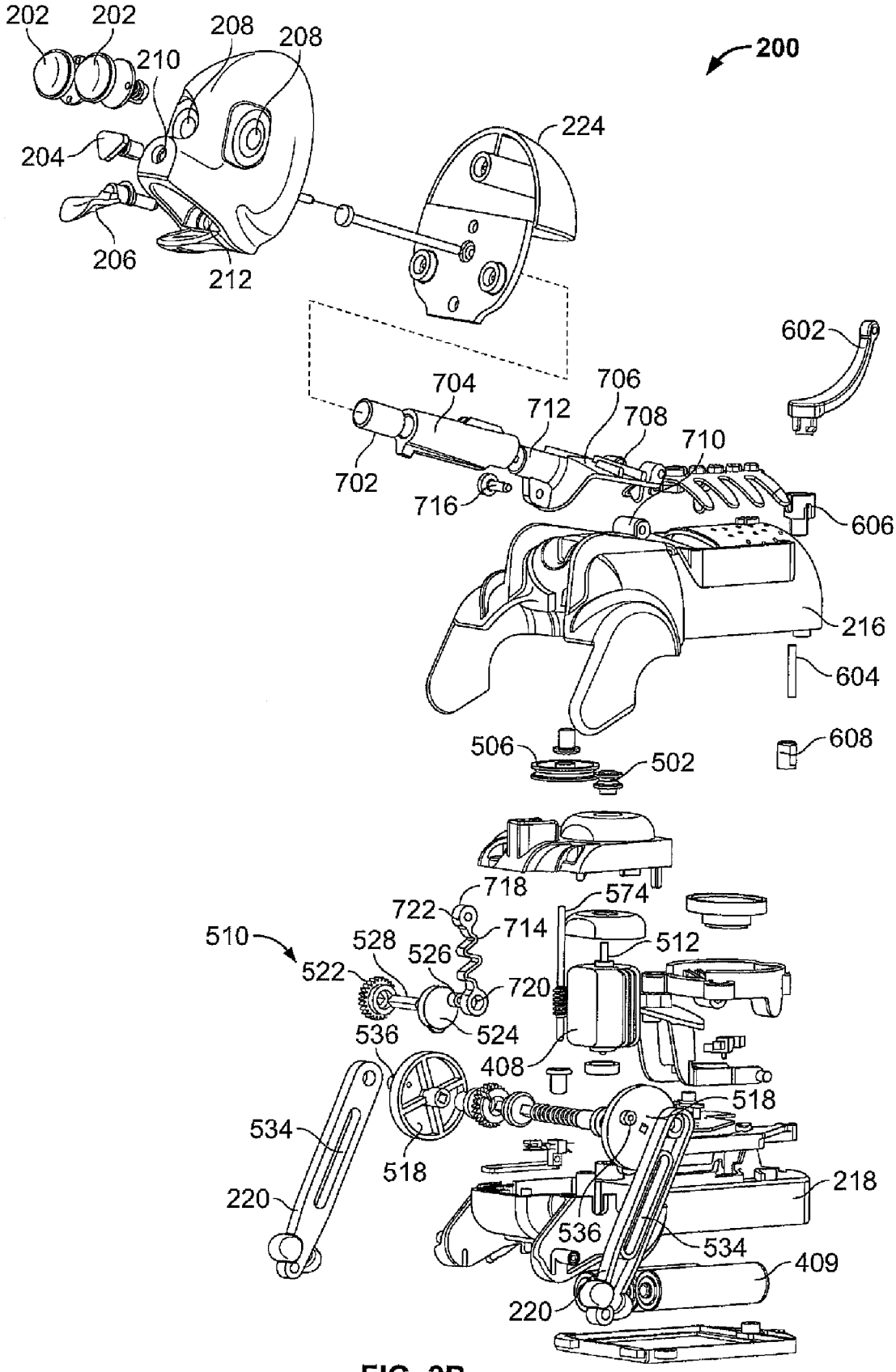
FIG. 2B is an exploded perspective view of the internal structure of FIG. 2A.

As shown in FIGS. 2A and 2B, posts shaped as, for example, eyes 202, a nose 204, and a tongue 206 interfit with cavities 208, a cavity 210, and a cavity 212, respectively, of the internal structure 200 to secure the external flexible skin 110 to the internal structure 200. The posts consist of a wider portion and a narrower portion. The flexible skin 110 is placed over the internal structure 200 such that the openings 112, 114, and 116 fit over the cavities 208, 210, and 212, respectively. The narrower portions of the eyes 202, nose 204, and tongue 206 are inserted into the cavities 208, 210, and 212, respectively. The wider portions of the posts hold the flexible skin 110 in place.

The internal structure 200 includes a body 214 which can be separated into a top portion 216 and a bottom portion 218. The bottom portion 218 houses many of the components that control operation of the toy 100. Connected to these components are one or more appendages 220, as well as a neck device 222 for connecting the body 214 to a head 224, and a tail device 226. The internal structure 200 may be made of any suitable combination of materials. For example, the body 214 and the appendages 220 may be made of plastic and/or metal.

Figure 3A:
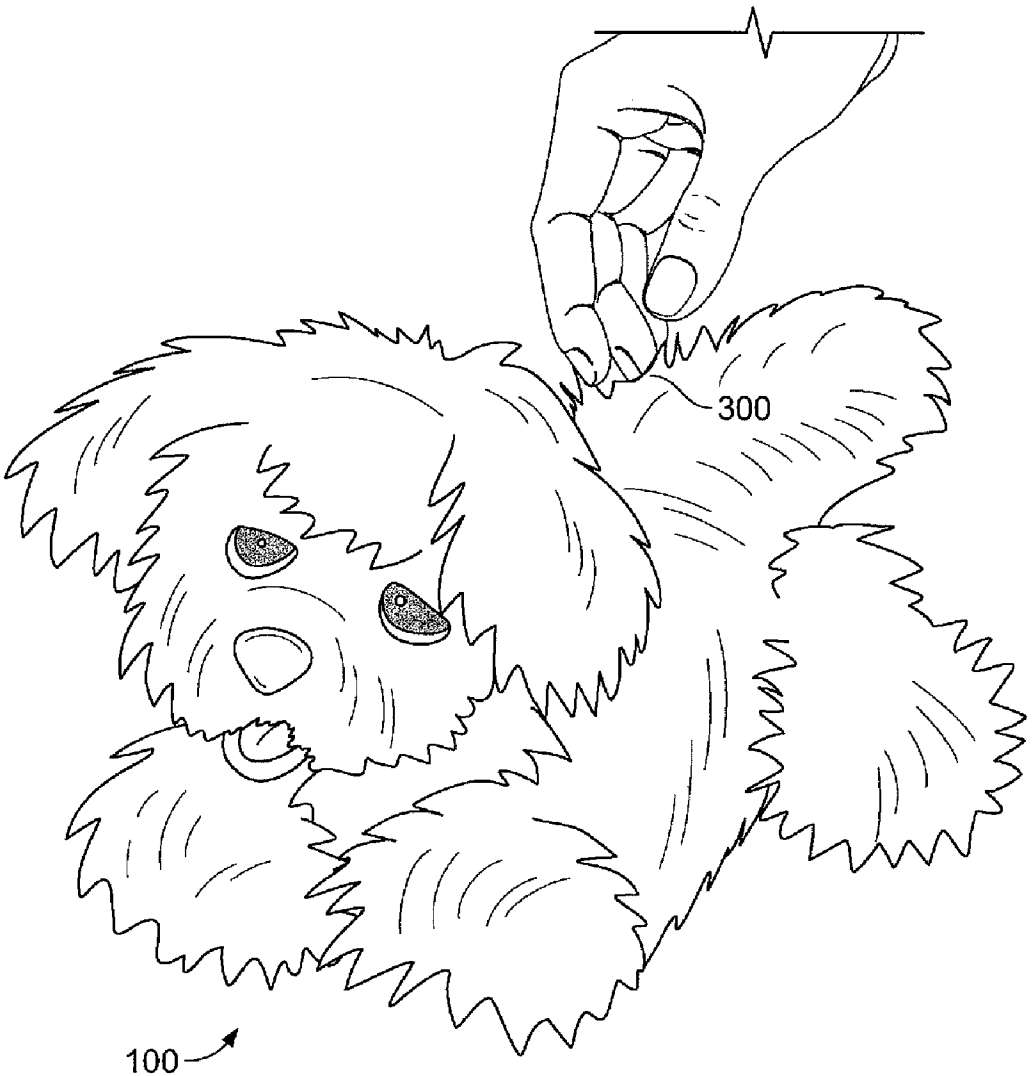
FIGS. 3A and 3B are perspective views of the toy of FIG. 1.
Figure 3B:
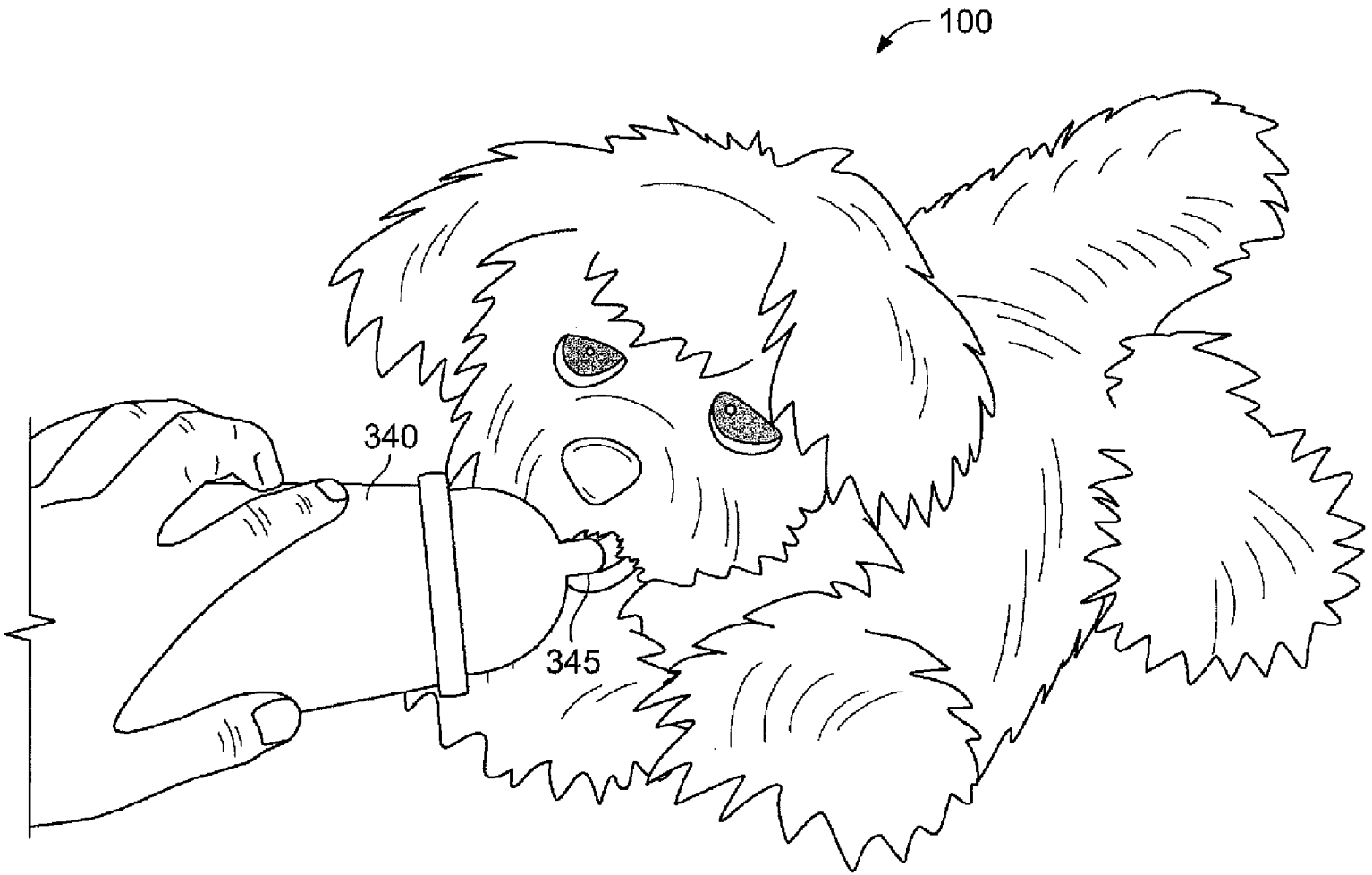

Any combination of the appendages 220, the neck device 222, and the tail device 226 may be actuated during operation of the toy 100 in response to input received from one or more input devices in the form of sensors 228 and 230. Referring also to FIG. 3A, the sensor 228 is a pressure sensitive switch that is depressed and pushes an underlying button switch when a user touches the toy 100 at a location 330 near the sensor 228. Referring also to FIG. 3B, the sensor 230 is a magnetic switch, such as, for example, a reed switch or a Hall effect sensor, that is actuated by a magnet within an accessory 340 when the accessory 340 is placed at a location 345 near the sensor 230.

Figure 4:
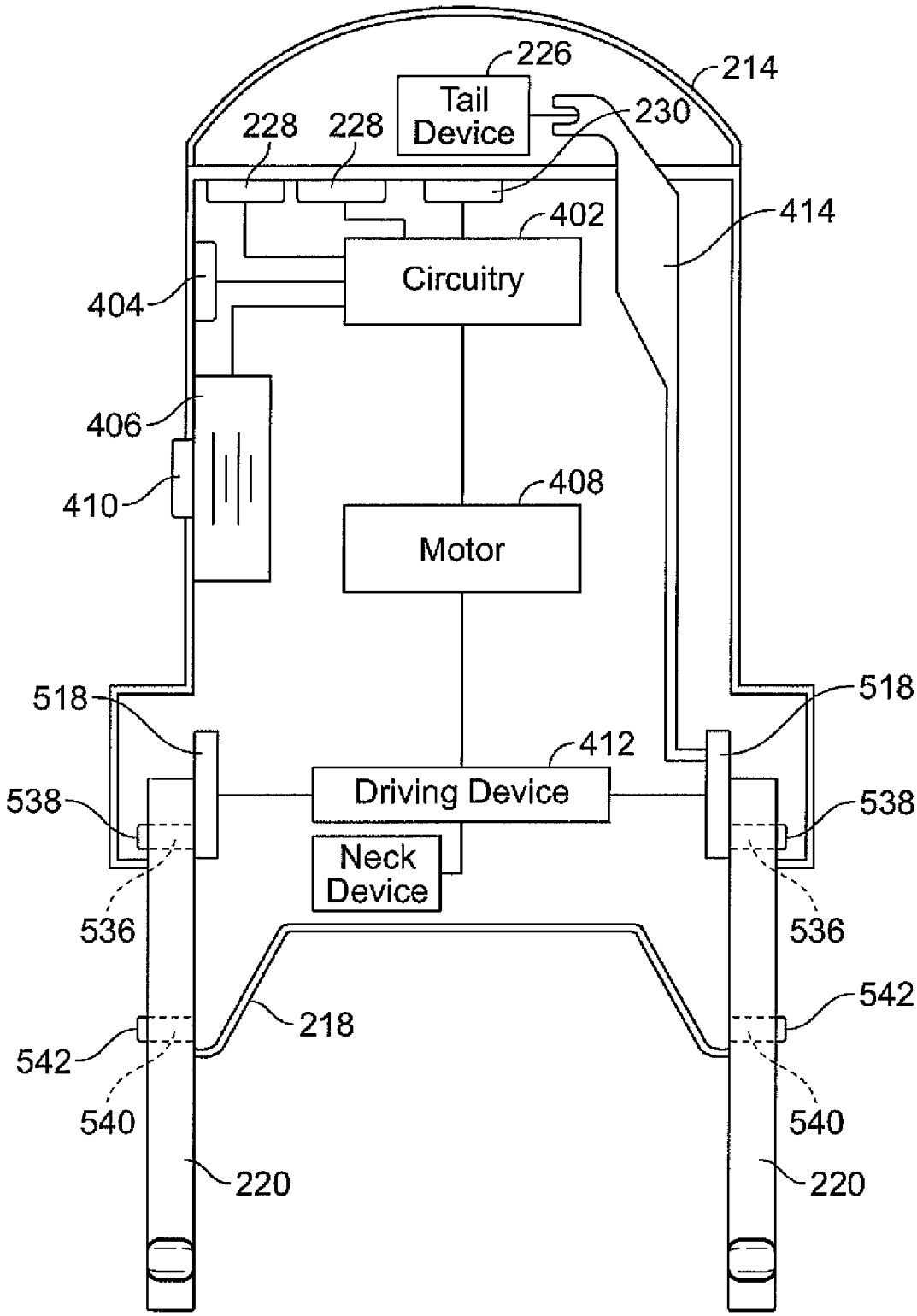
FIG. 4 is a block diagram of the toy of FIG. 1.

As shown in FIG. 4, internal circuitry 402 and an output device in the form of an audio device 404 are housed within the body 214. The sensors 228 and 230 and the audio device 404 are connected to the circuitry 402. The circuitry 402 receives power from an energy source 406 and controls operation of a motor 408 housed within the body 214. The energy source 406 may be provided by batteries 409, shown in FIG. 2B, that are placed within a compartment on an underside of the body 214. The circuitry 402 is turned off and on by a switch 410 that is accessible on the body 214. A driving device 412 that is housed within the body 214 couples the motor 408 to the neck device 222, the appendages 220, and the tail device 226, which is attached to one appendage 220 by a long connector piece 414.

Figure 5:
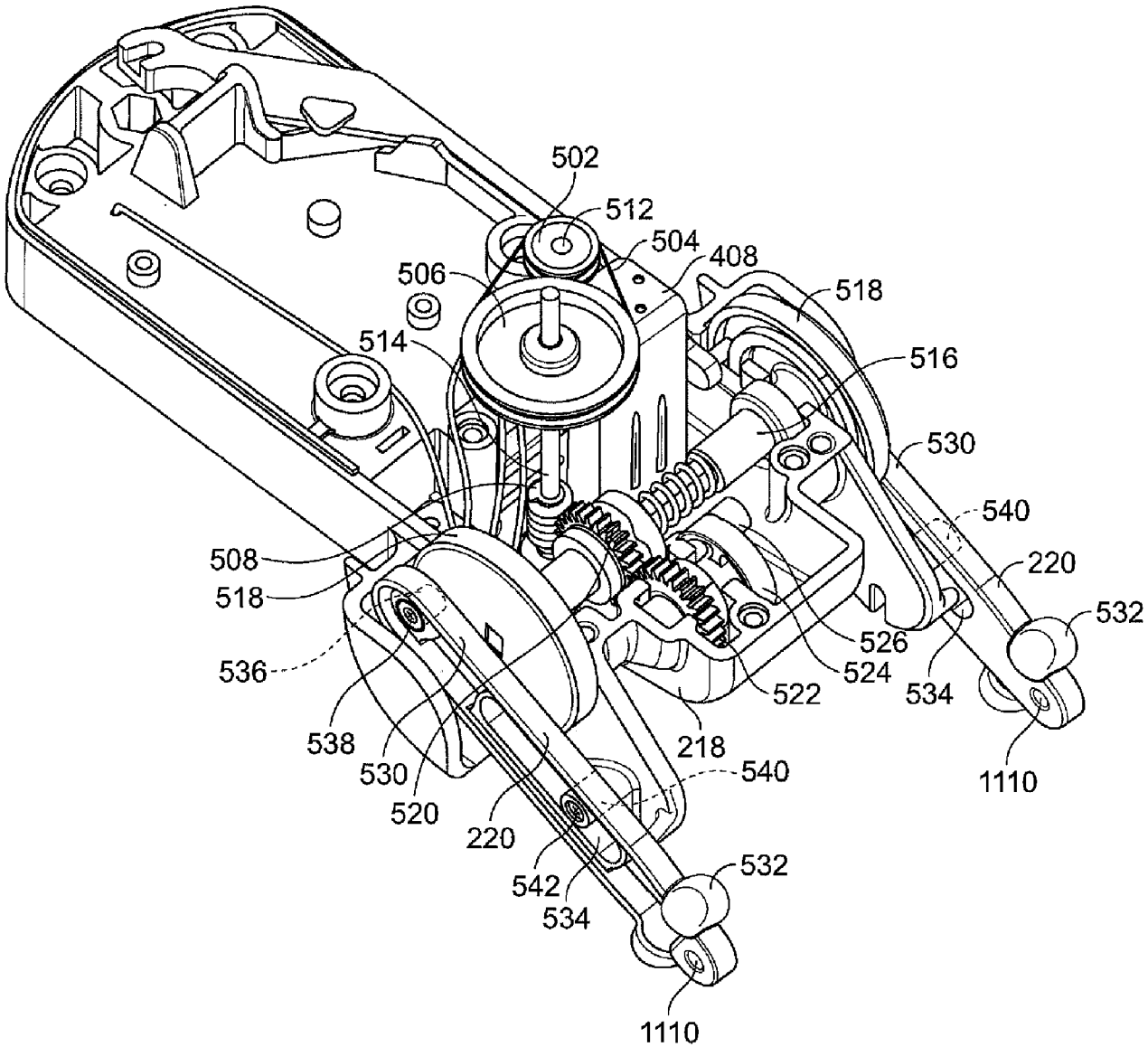
FIG. 5 is a perspective view of an interior of a bottom portion of the internal structure of the toy of FIG. 1.

Referring to FIG. 5, the motor 408 includes a pulley 502, a flexible belt 504, a pulley 506, a worm gear 508, and a shaft system 510 (discussed below). The pulley 502 is mounted on and frictionally engages a shaft 512 of the motor 408. The flexible belt 504 is connected to the pulley 502 and the pulley 506, such that rotation of the pulley 502 causes rotation of the pulley 506. The pulley 506 and the worm gear 508 are mounted on and fixed to a shaft 514 that is connected the body 214.

Referring also to FIGS. 2B, 5, and 6, the shaft system 510 includes a disk shaft 516 that spans the width of the bottom portion 218 and is connected to centers of a pair of cams 518. The shaft system 510 also includes a gear 520 that is fixed on the disk shaft 516 and coupled to the worm gear 508. The shaft system 510 includes a gear 522 having teeth that mate with teeth of the gear 520 and a rounded piece 524 having an eccentric protrusion 526. The gear 522 and the rounded piece 524 are mounted to a shaft 528 (shown in FIG. 2B).

Each of the appendages 220 includes a first end 530, a second end 532, and a slot 534 that extends between the first and second ends 530 and 532. The cams 518 couple the appendages 220 to the disk shaft 516. Each cam 518 includes an eccentric rod 536 that is positioned along and is integral with an outer surface of the cam 518. The first end 530 of the appendage 220 includes a first screw 538 for connecting the eccentric rod 536 to the appendage 220.

The bottom portion 218 of the body 214 includes a linkage rod 540 that is positioned along and integral with an outer surface of the bottom portion 218. The slot 534 of the appendage 220 is wide enough to accommodate the linkage rod 540, which is engaged with the slot 534. The linkage rod 540 is constrained to the slot 534 by a second screw 542.

The first end 530 of the appendage 220 is rotatably fixed to the eccentric rod 536 and the second end 532 of the appendage 220 is free to move along paths constrained by the engagement of the linkage rod 540 with the slot 534 and the second screw 542. In this way, overall motion of the appendage 220 is constrained by the engagement of the slot 534 with the fixed linkage rod 540 and by the fixed connection of the first end 530 to the eccentric rod 536.

Figure 6A:
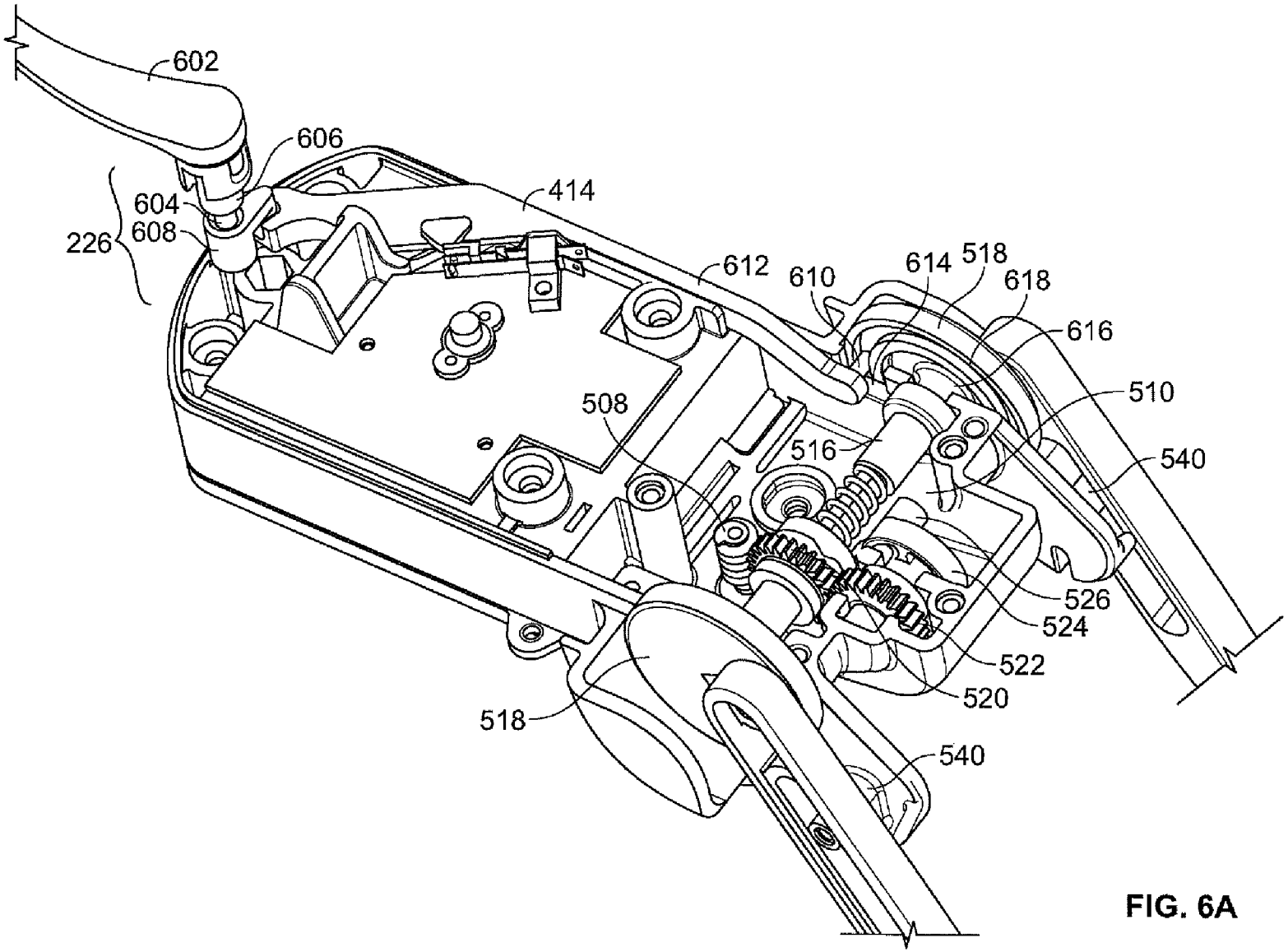
FIG. 6A is a perspective view of the internal structure including a tail device of the toy of FIG. 1.

Referring to FIG. 6A, the tail device 226 includes a tail-shaped piece 602, a shaft 604 extending from the tail-shaped piece 602, a middle piece 606 fixed to the shaft 604, and a lower piece 608 fixed to the shaft 604. The tail device 226 is coupled with the disk shaft 516 through a long connector piece 414.

Figure 6B:
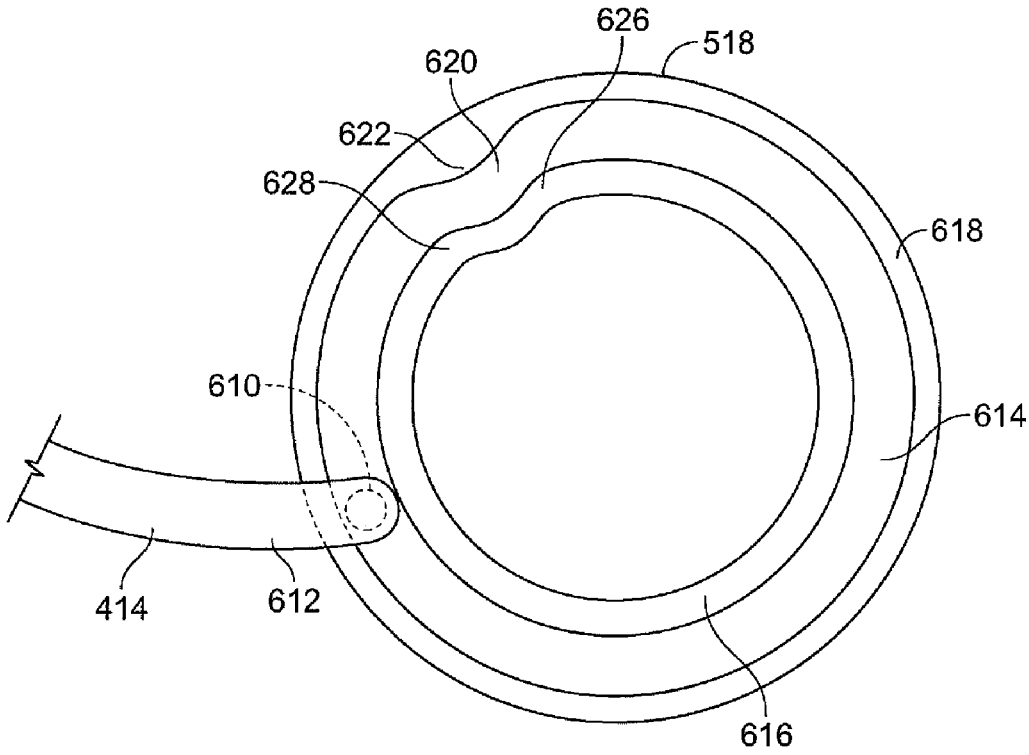
FIG. 6B is a side view of a part of the tail device of the toy of FIG. 1.

Referring also to FIG. 6B, the long connector piece 414 includes a shaft 610 that protrudes from an end 612 of the piece 414 and fits within a groove 614 of one of the cams 518. The groove 614 is created by an inner wall 616 and an outer wall 618 of the cam 518. The groove 614 is circular except for a shallow unshaped curve 620 caused by a protrusion 622 in the outer wall 618 and a dimple 624 in the inner wall 616.

Referring to FIGS. 2A, 2B, 7A and 7B, the neck device 222 includes a first piece 702 attached to the head 224, a second piece 704 attached to the first piece 702, and a third piece 706 attached to the second piece 704. One end 708 of the third piece 706 is attached to the top portion 216 at a hinge 710. Another end 712 of the third piece 706 is attached to a follower 714 by a bolt 716. The follower 714 is shaped with a first hole 718 for receiving the bolt 716 and a second hole 720 for connecting with the protrusion 526 of the rounded piece 524. The follower 714 includes a middle pliable portion 722 having a zigzag shape between the holes 718 and 720.

Figure 8:
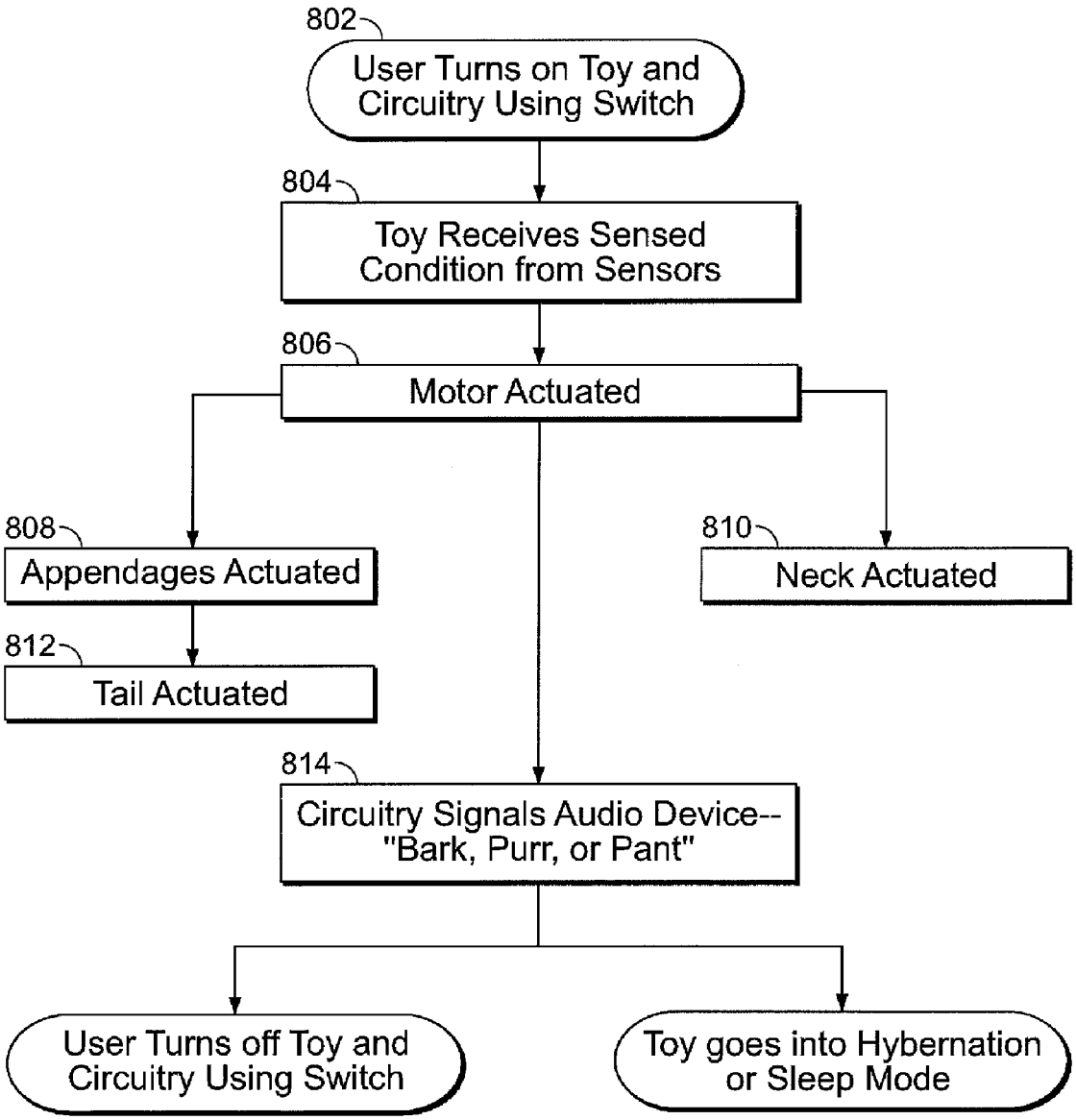
FIG. 8 is a flow chart of a method of operating the toy of FIG. 1.
Figure 9A:
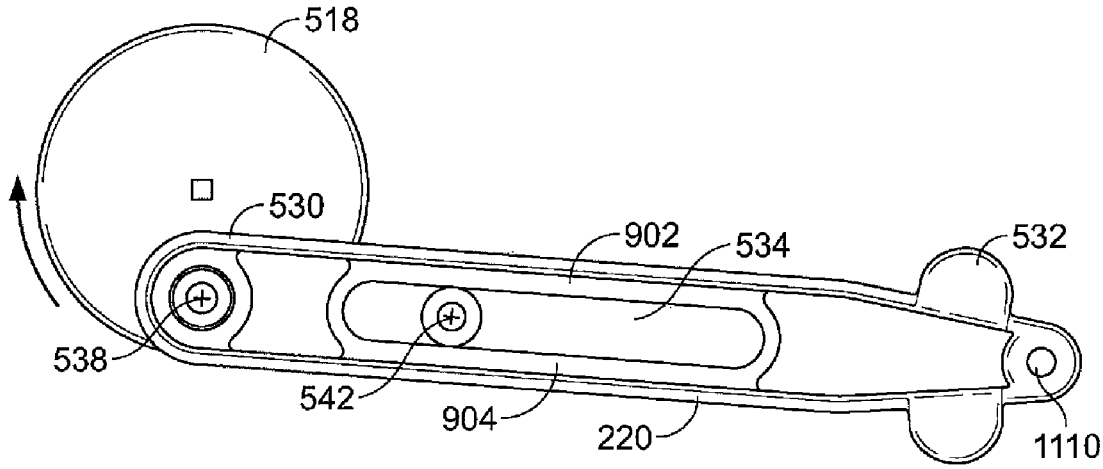
FIGS. 9A-9G are side views of an appendage of the internal structure of FIG. 2A.
Figure 9B:
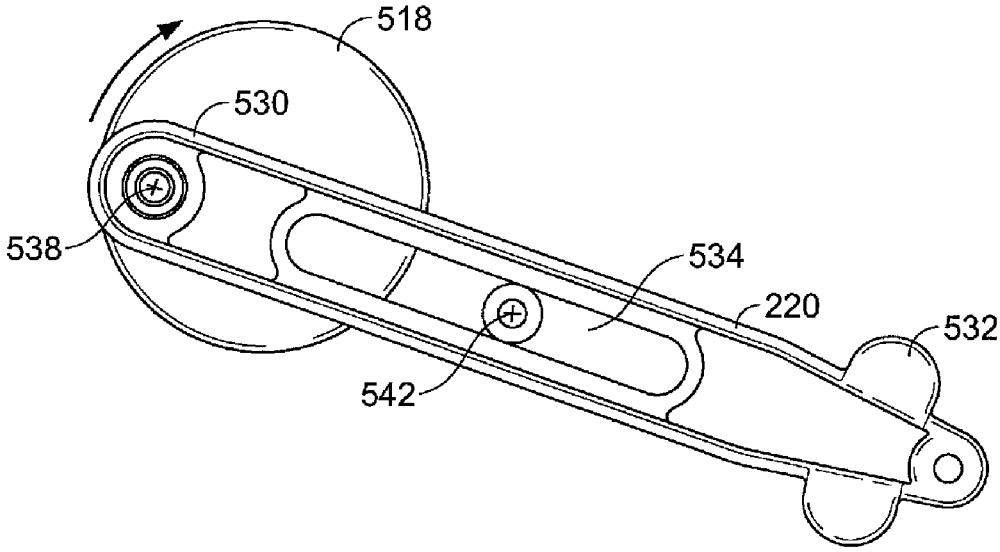
Figure 9C:
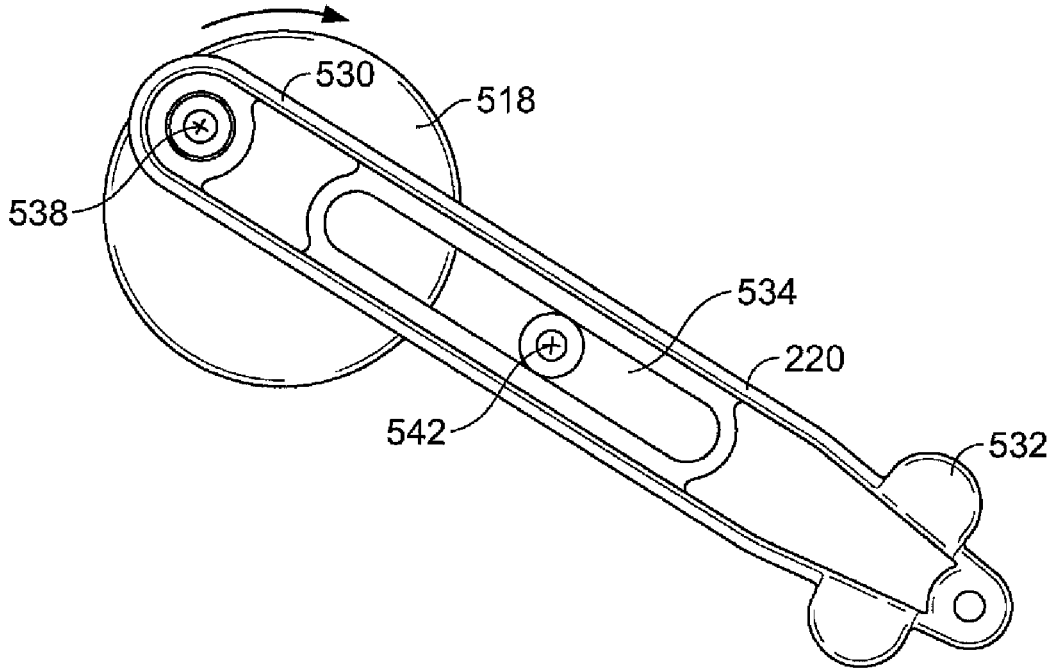
Figure 9D:
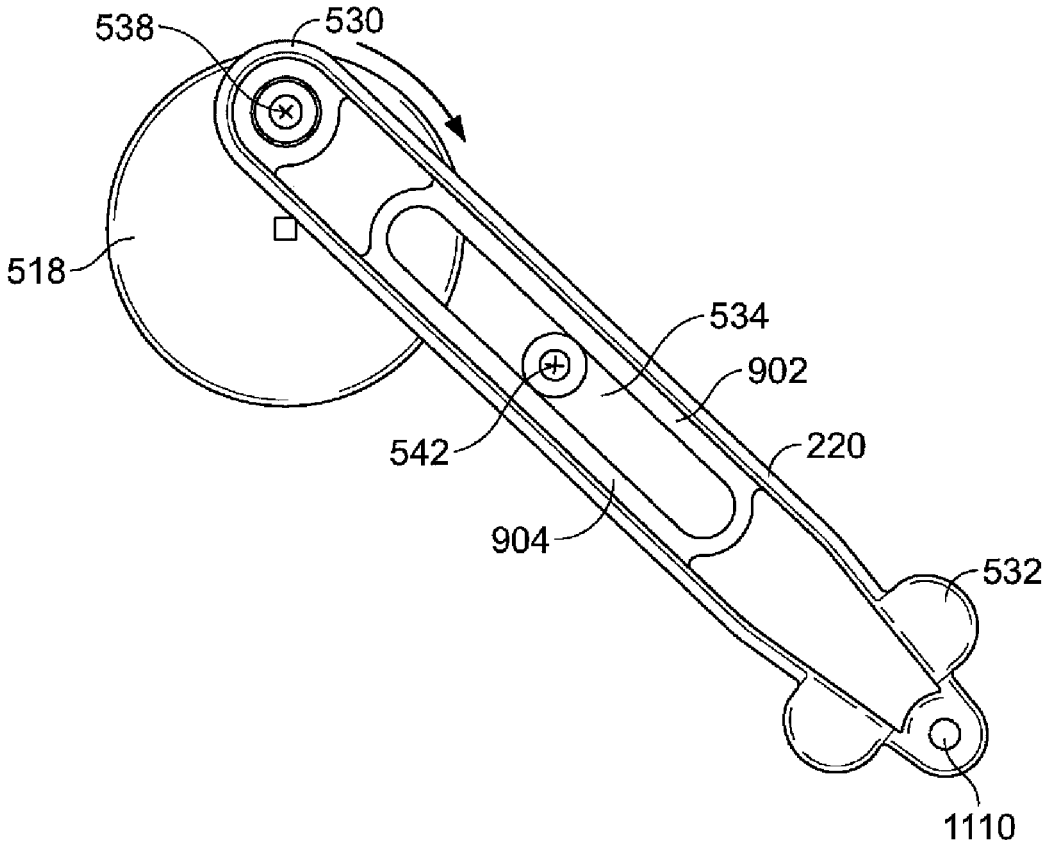
Figure 9E:
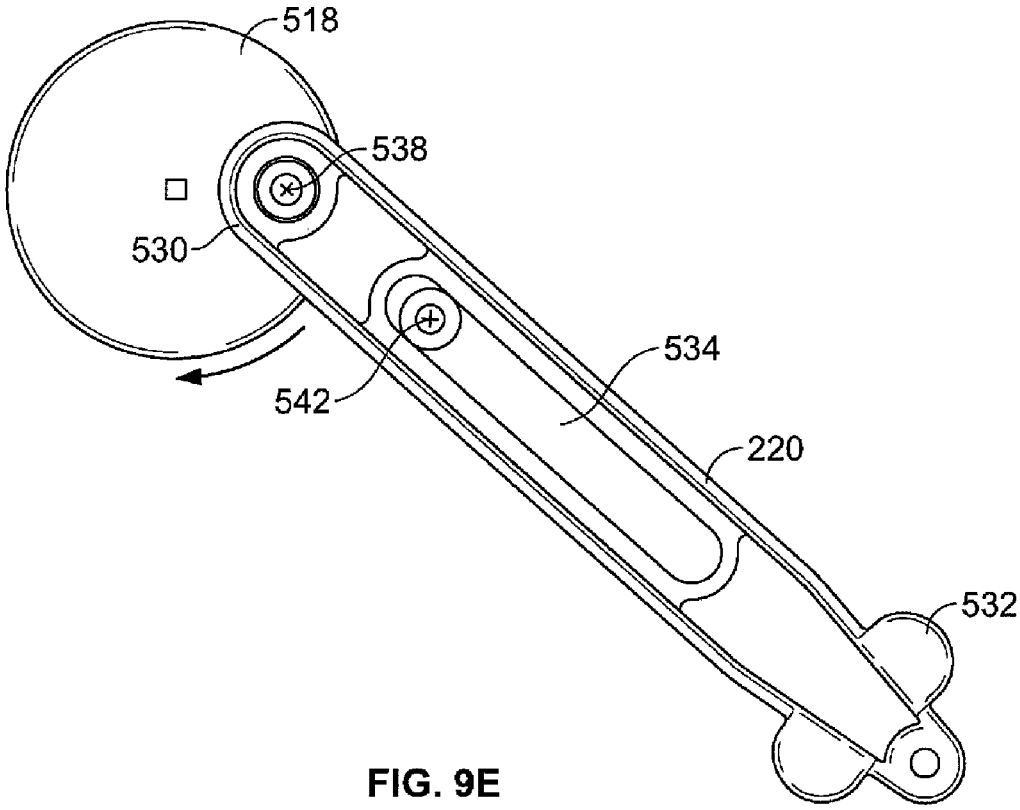
Figure 9F:
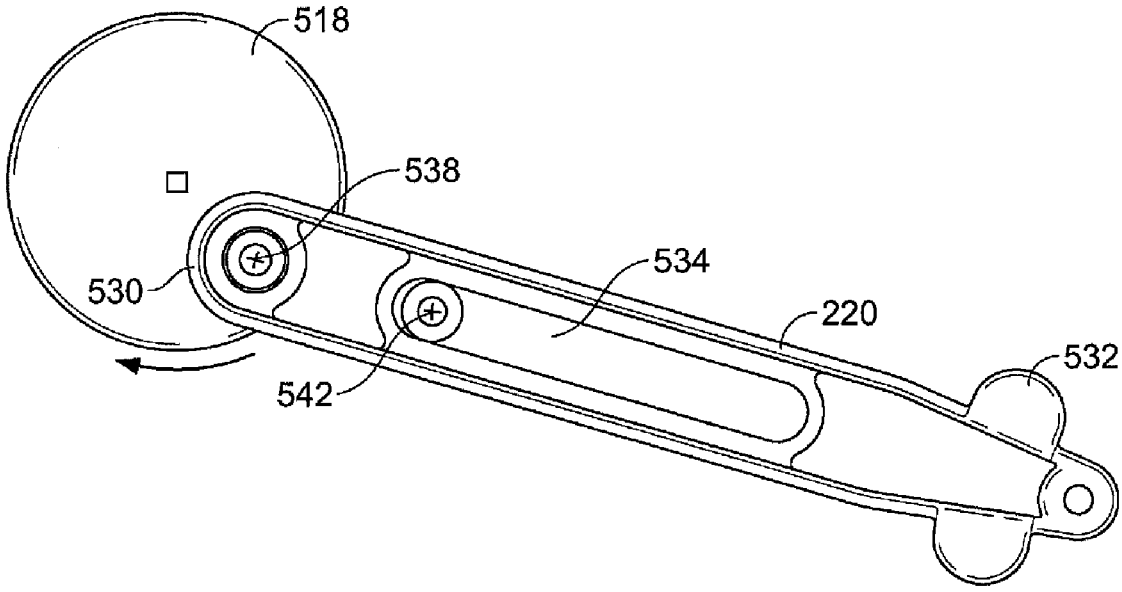
Figure 9G:
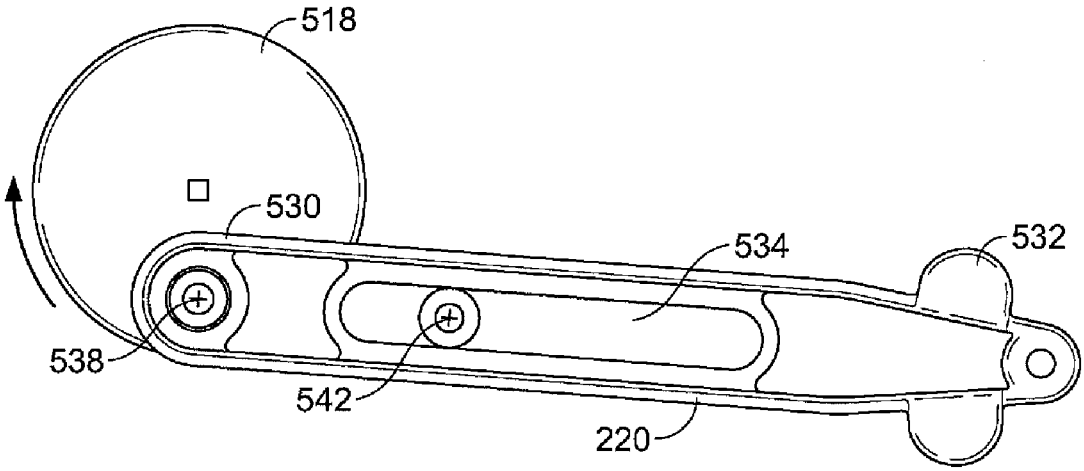

Referring to FIG. 8, the user turns on the toy 100 and the circuitry 402 by actuating the switch 410 (step 802). Upon receipt of a sensed condition (step 804) (for example from an input device 228 or 230), the circuitry 402 actuates the motor 408 (step 806), which actuates some combination of movements of the appendages 220 (step 808), the neck device 222 (step 810), and the tail device 226 (step 812) (described below). To further enhance realism, the circuitry 402 sends a signal to the audio device 404 (step 814) to output a sound such as, for example, a bark, a pant, or a purr, as the motor actuates the combination of movements (steps 808 through 812).

Referring also to FIG. 5, actuation of the motor 408 (step 806) causes the motor shaft 512 and the pulley 502 mounted on the shaft 512 to rotate. The rotation of the pulley 502 moves the flexible belt 504, which causes the pulley 506 to rotate. The actuation of pulley 506, in turn, rotates the shaft 514 and thereby rotates the worm gear 508 mounted the shaft 514. The rotating worm gear 508 engages and rotates the gear 520, which actuates the disk shaft 516.

With reference to FIGS. 2B, 5, 6, 7A, and 7B, as mentioned, actuation of the motor 408 (step 806) causes actuation of the neck device (step 810). Rotation of gear 520 on the disk shaft 516 causes the gear 522 to rotate. Rotation of the gear 522 causes the rounded piece 524 and the protrusion 526 on the rounded piece 524 to rotate. The rotation of the protrusion 526 translates into a motion of the lower end of the follower 714, which is attached to the protrusion 526 at the second hole 720. In particular, the motion of the rounded piece 524 drives the protrusion 526, which drives the lower end of the follower 714 in a circular path. An upper end of the follower 714 that includes the first hole 718 describes a radial path that is constrained by the hinge 710 attached to the first hole 718. The motion of the follower 714 moves the neck device 222, which is attached at the third piece 706 to the follower 714 by the bolt 716. The actuation of the neck device 222 moves the head 224, which is attached to the neck device 222. The motion of the follower 714 translates into an up and down motion of the neck device 222 and the head 224.

Figure 7A:
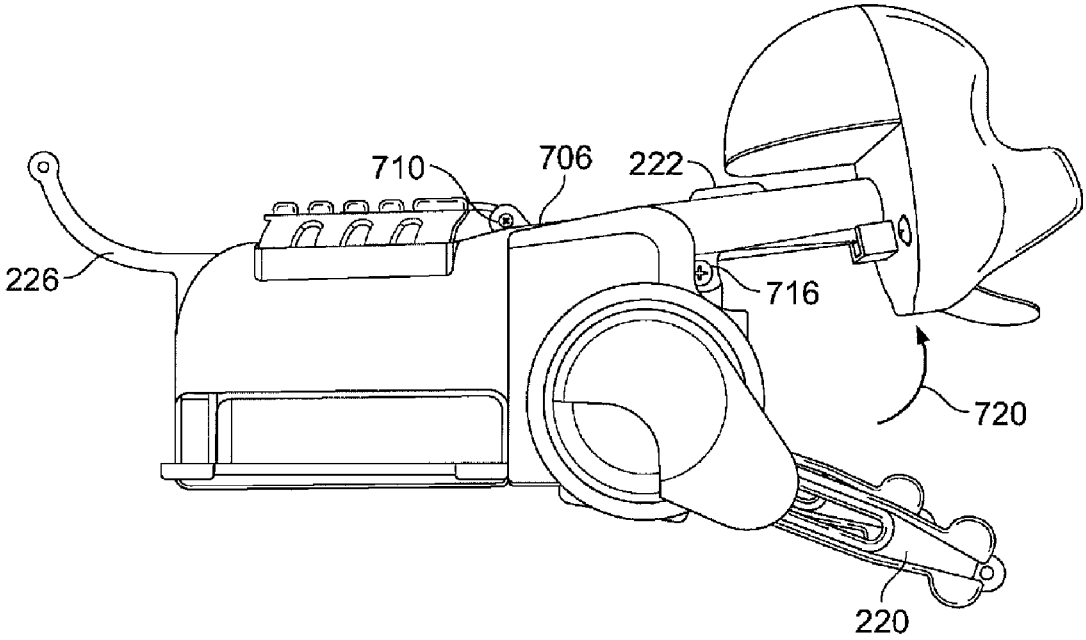
FIGS. 7A and 7B are side views of the internal structure of the toy of FIG. 1.
Figure 7B:
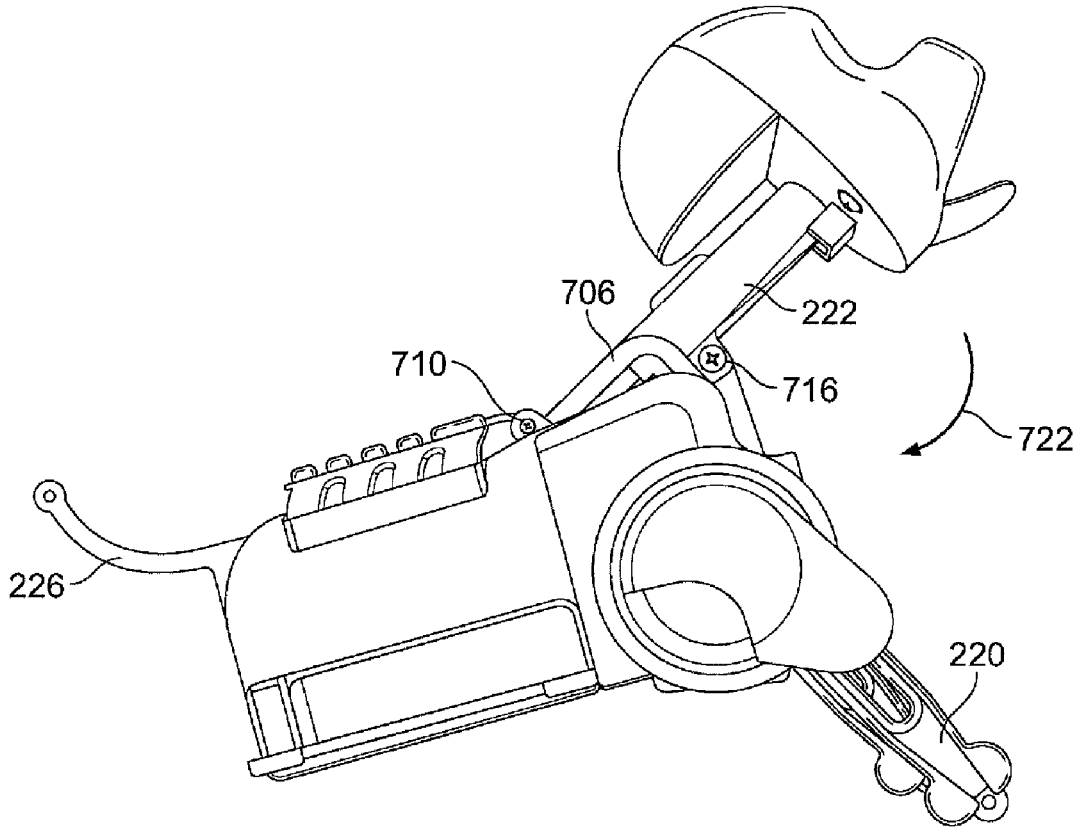

As the motion of the follower 714 reaches its apogee, the neck device 222 and the head 224 are raised, as shown by an arrow 720 in FIG. 7A. As the motion of the follower 714 reaches its perigee, the neck is lowered, as shown by an arrow 722 in FIG. 7B.

As mentioned above, actuation of the motor 408 (step 806) causes actuation of the appendages 220 (step 808). With particular reference to FIGS. 9A-9G, actuation of the driving device 412 results in the simultaneous rotation of the cams 518. In particular, as discussed, the motor 408 rotates the disk shaft 516. The rotation of the disk shaft 516 causes the cams 518 to rotate. Referring to FIGS. 9A-9G, as a cam 518 rotates, the first end 530 of the appendage 220 that is attached to the cam 518 by the eccentric rod 536 and the first screw 538 rotates with the cam 518 in a circular path. As the first end 530 rotates, the motion of the appendage 220 is constrained by the second screw 542 and the fixed linkage rod 540. This limitation arises as a result of the contact of the linkage rod 540 with edges 902 and 904 of the slot 534. Rotation of the first end 530 of the appendages 220 causes the appendage 220 to pivot about and move transversely to the linkage rod 540, which causes the second end 532 to move in a non-circular or irregular path as shown by the sequence of FIGS. 9A-9G.

As mentioned, with reference to FIGS. 6A and 6B, the actuation of the appendages 220 drives the tail device 226. The inner wall 616 and the outer wall 618 contain the movement of the shaft 610 as the cam 518 rotates relative to the shaft 610. As the circular portion of the groove 614 rotates and engages the shaft 610, the arm 414 does not move significantly and remains in a default position. As the cam 518 continues to rotate, an upper portion 626 of the shallow u-shaped curve 620 engages the shaft 610, and the long connector piece 414 moves down and inward toward the center of the cam 518 as a result of the dip of the shallow u-shaped curve 620. As the cam 518 continues to rotate, a lower portion 628 of the shallow u-shaped curve 620 engages the shaft 610. As the cam 518 continues to rotate, the lower portion 628 disengages the shaft 610 and the long connector piece 414 moves up and away from the center of the cam 518 and back to its default position.

The movement of the long connector piece 414 towards and away from the center of the cam 518 causes the long connector piece 414 to pull on and release the lower piece 608 of the tail device 226. Movement of the lower piece 608 causes the shaft 604 to rotate, which causes the tail device 226 to rotate. The overall movement of the tail device 226 imparts a realistic appearance of a dog wagging its tail.

Figure 10:
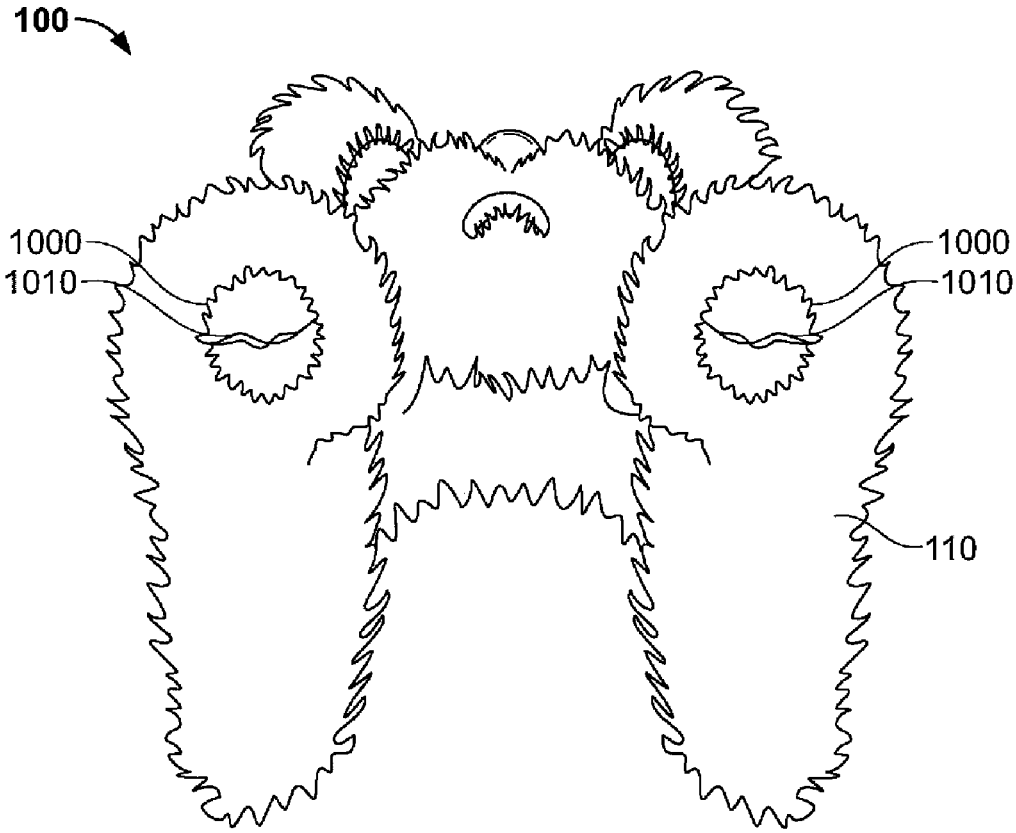
FIG. 10 is a perspective view of an underside of the toy of FIG. 1.
Figure 11A:
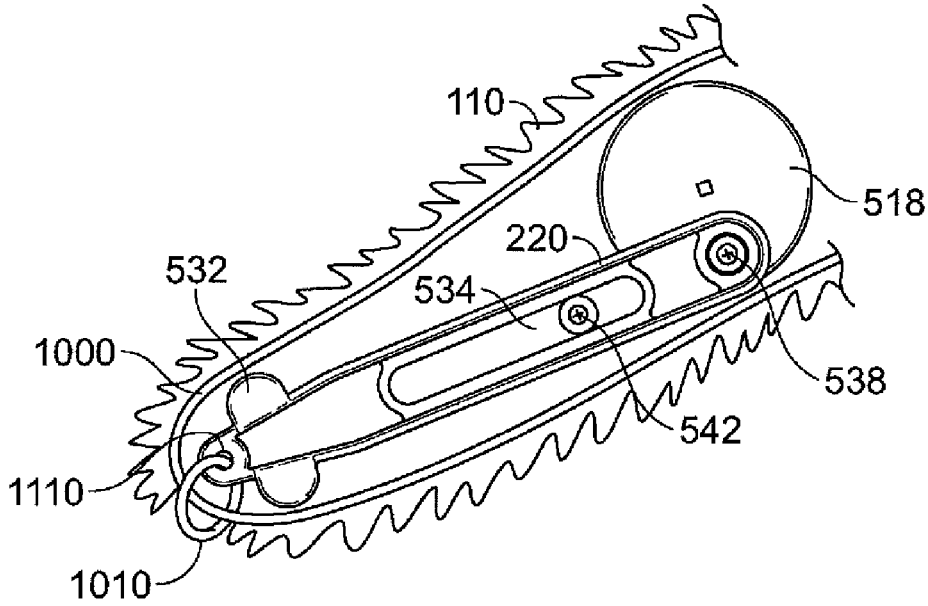
FIGS. 11A and 11B are side and partial cutaway views of the appendage and an external flexible skin of the toy of FIG. 1.
Figure 11B:
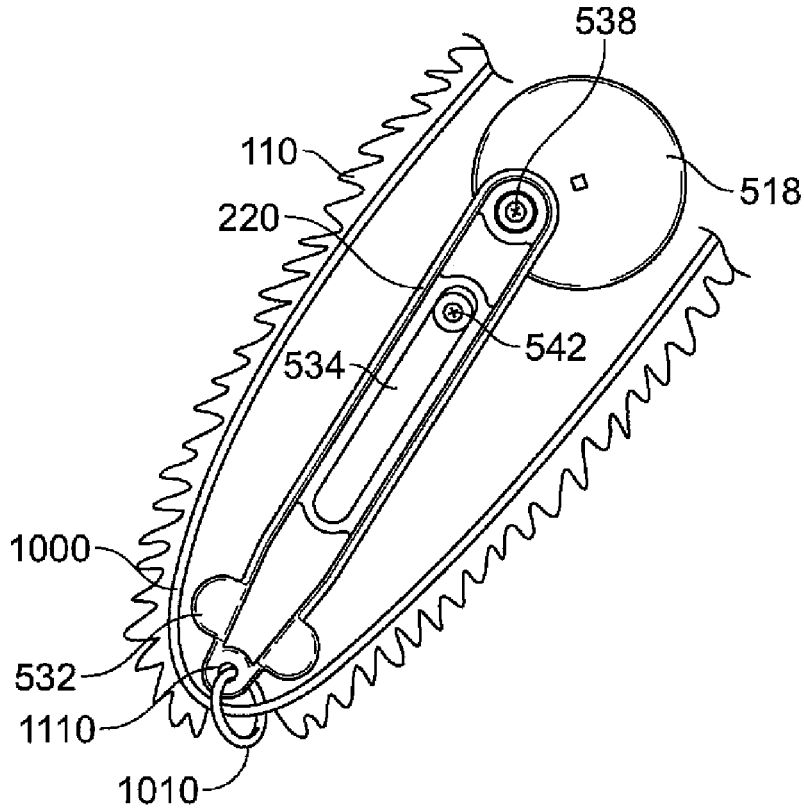

Referring also to FIGS. 10, 11A, and 11B, a portion 1000 of the external flexible skin 110 is fastened to the second end 532 of the appendage 220. For example, the portion 1000 may be sewn with thread 1010 to an eye 1110 formed in the second end 532. As the second end 532 traverses the range of motion shown in FIGS. 9A-9G, the portion 1000 of the skin 110 is periodically pulled toward (tensioning) and away from (slackening) the second end 532. This periodic tensioning and slackening causes the skin 110 in the portion 1000 to deform during the cycle. The overall motion of the appendages 220 and the skin 110 of the toy 100 imparts a realistic appearance of a dog moving its paws.

Other implementations are within the scope of the following claims. For example, the toy 100 may be of any design, such as, for example, a doll, a plush toy such as a stuffed animal, a dog or other animal, or a robot.

One or more of the sensors 228 or 230 may be touch-sensitive devices. For example, one or more of the sensors 228 or 230 may be a pressure sensing device such as, for example, a pressure-activated switch in the form of a membrane switch. As another example, a sensor 228 or 230 may be made of a conductive material and may be an inductively-coupled device. In this case, when a user touches the toy 100 at the location of the inductive sensor, a measured inductance associated with the inductive sensor changes and the change is sensed. As a further example, a sensor 228 or 230 may be made of a conductive material and may be a capacitively-coupled device such that when a user touches the toy 100 at the location of the capacitive sensor, a measured capacitance associated with the sensor changes and the change is sensed. One or more of the sensors 228 or 230 may be a light-sensing device, such as, for example, an IR-sensing device or a photocell. Additionally or alternatively, one or more of the sensors 228 or 230 may be a sound-sensing device such as, for example, a microphone.

The output device may be an optical device, such as, for example, a lamp or a light emitting diode, or an electromechanical device. The flexible skin 110 may include a resilient material to further enhance realism of the toy 100.

In another implementation, actuation of the driving device 412 results in an in-phase motion of the appendages 220. Thus, for example, as one appendage 220 reaches an apex of the cycle, the other appendage 220 reaches an apex of the cycle. In another implementation, actuation of the driving device 412 results in an out-of-phase motion of the appendages 220. Thus, for example, as one appendage 220 reaches an apex of the cycle, the other appendage 220 reaches another point of the cycle.

Figure 12:
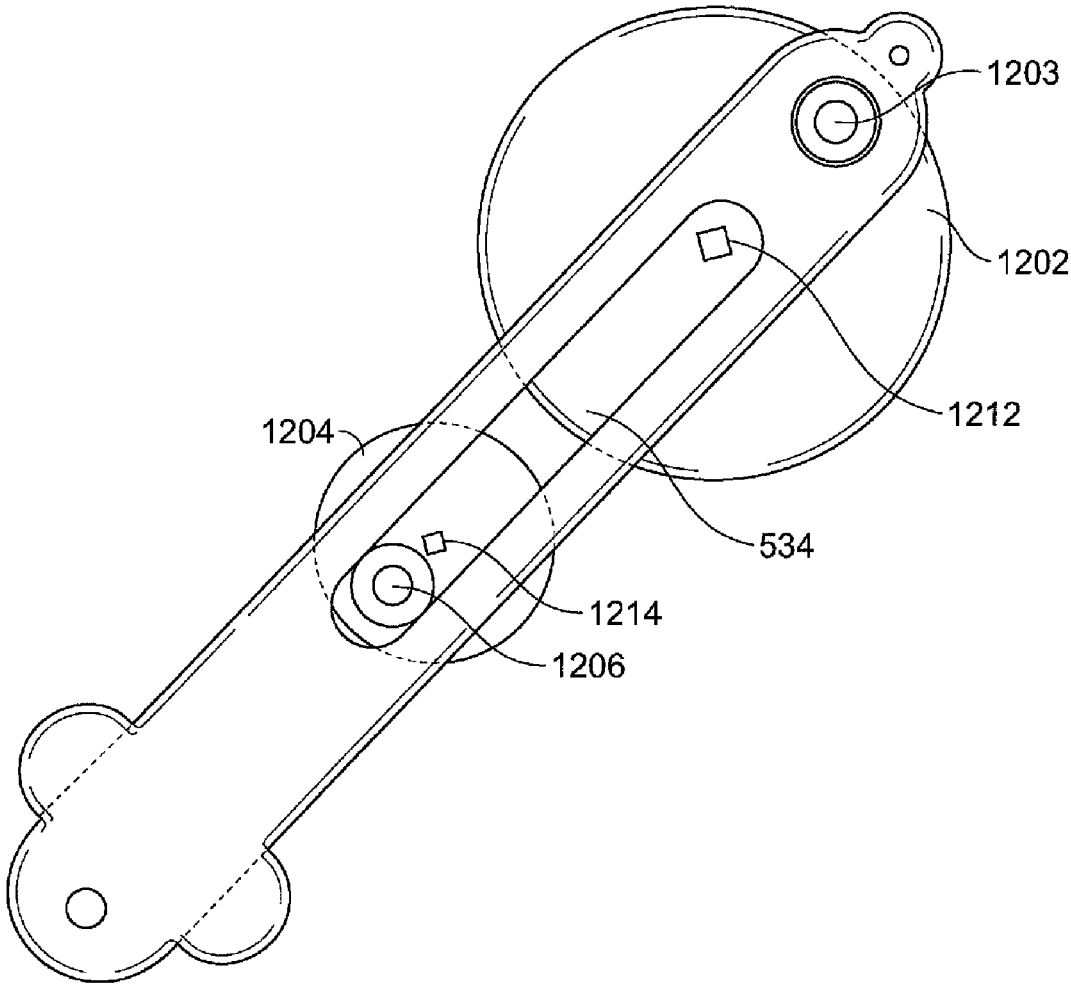
FIG. 12 is a side view of an appendage of the internal structure of the toy of FIG. 2A.

Referring to FIG. 12, in another implementation, the appendages 220 are coupled to the disk shaft 516 with a crank gear 1202 and a pivot gear 1204. The crank gear 1202 includes a center shaft 1212 that is connected to and driven by the disk shaft 516. The appendage 220 is rotatably fixed to the crank gear 1202 at a point 1203. The pivot gear 1204 includes a center post 1214 rotatably mounted to the body 214 and teeth that mesh with teeth of the crank gear 1202. The pivot gear 1204 includes a post 1206 that is rotatably and slidably received within the slot 534 of the appendage 220.

In operation, the disk shaft 516 drives the crank gear 1202, which in turn drives the pivot gear 1204. The motion of the pivot gear 1204 allows the post 1206 in the slot 534 to move back and forth through the slot 534 about an arc defined by the shape of the slot 534. The resulting motion moves the appendage 220 through a path that is repeatable for every one revolution of the crank gear 1202.

The pivot gear 1204 may have half the number of gear teeth as the crank gear 1202, such that the pivot gear 1204 operates at twice the speed of the crank gear 1202. Thus, as the pivot gear 1204 completes one revolution, the crank gear 1202 completes one half of a revolution.

What is claimed is:

1. A toy comprising:

a body at least partly directly contacting a horizontal supporting surface;

a motor within the body;

an appendage having a body portion that is coupled to the body of the toy, and a support portion that at least partly directly contacts the horizontal supporting surface to at least partly support the body, wherein the appendage is actuated by the motor to move relative to the body along a first path including movement of the support portion of the appendage along a non-circular path without advancing the body along the horizontal supporting surface;

a tail device coupled to the body of the toy and actuated by the motor to move relative to the body along a second path; and a neck device coupled to the body of the toy and actuated by the motor to move relative to the body along a third path.

2. The toy of claim 1 in which the movement of the neck device, the tail device, and the appendage occurs simultaneously.

3. The toy of claim 1 further comprising a drive shaft that couples the motor to the appendage.

4. The toy of claim 3 further comprising a cam that receives the drive shaft such that rotation of the drive shaft rotates the cam.

5. The toy of claim 4 wherein an eccentric rod to which the appendage connects extends from the cam.

6. The toy of claim 5 further comprising a pivot gear coupled to the body of the toy and including a post that couples to a slot within the appendage, wherein gear teeth that mesh with gear teeth of the pivot gear extend from the cam such that rotation of the cam causes rotation of the pivot gear, which causes the appendage to move along the first path.

7. The toy of claim 5 further comprising a linkage rod coupled to the body of the toy and to a slot within the appendage, wherein rotation of the cam causes the appendage to move along the first path.

8. The toy of claim 3 wherein the drive shaft couples the motor to the tail device.

9. The toy of claim 8 further comprising a cam that receives the drive shaft such that rotation of the drive shaft rotates the cam.

10. The toy of claim 9 further comprising a connector piece within the body that connects to the tail device and couples to the cam such that rotation of the cam oscillates the connector piece.

11. The toy of claim 10 wherein the cam defines a groove that receives a shaft of the connector piece.

12. The toy of claim 10 wherein the connector piece connects to a lower piece of the tail device to cause the tail device to oscillate about a tail axis as the connector piece oscillates due to rotation of the cam.

13. The toy of claim 12 wherein the second path of movement has the appearance of a wagging tail.

14. The toy of claim 3 wherein the drive shaft couples the motor to the neck device.

15. The toy of claim 14 further comprising a head connected to the neck device.

16. The toy of claim 14 wherein the neck device includes a hinge attached to the body such that the neck device is configured to rotate about the hinge as the neck device moves along the third path.

17. The toy of claim 16 further comprising a follower attached to the neck device and coupled to the drive shaft such that rotation of the drive shaft moves the follower in a periodic pattern and causes the neck device to move along the third path.

18. The toy of claim 1 further comprising:

a controller within the body and coupled to the motor; and a sensor connected to send a signal to the controller;

wherein the controller causes the motor to operate in response to a signal from the sensor.

19. The toy of claim 1 further comprising another movable appendage shaped like the movable appendage and also having a body portion that is coupled to the body of the toy, and a support portion that at least partly contacts the horizontal supporting surface to at least partly support the body.

20. The toy of claim 19 wherein each of the appendages is positioned such that the support portions of the appendages move in non-circular paths that are aligned with each other.

21. The toy of claim 1 further comprising a flexible skin surrounding the body of the toy.

22. The toy of claim 21 wherein the flexible skin includes pile that resembles an animal's coat.

23. The toy of claim 21 wherein the flexible skin surrounds the appendage of the toy and moves as the appendage moves.

24. A toy comprising:

a body at least partly contacting a horizontal supporting surface;

a motor within the body;

an appendage coupled at a first end to the body of the toy and actuated by the motor to rotate at the first end relative to the body about a first axis such that rotation at the first end causes movement of a second end of the appendage along a non-circular path without advancing the body along the horizontal supporting surface wherein the second end of the appendage at least partly directly contacts the horizontal supporting surface to at least partly support the body;

a tail device coupled to the body of the toy and actuated by the motor to rotate relative to the body about a second axis that is perpendicular with the first axis;

a neck device coupled to the body of the toy and actuated by the motor to rotate relative to the body about a third axis that is parallel with the first axis; and a flexible skin over at least the body and the appendage, and being attached to a part of the second end such that the flexible skin periodically tensions and slackens at the second end of the appendage as the second end of the appendage moves along the non-circular path.

25. The toy of claim 24 in which the rotation of the appendage, the tail device, and the neck device occurs simultaneously.

26. The toy of claim 24 further comprising a drive shaft that couples the motor to the appendage.

27. The toy of claim 26 further comprising a cam that receives the drive shaft such that rotation of the drive shaft rotates the cam.

28. The toy of claim 27 wherein the cam includes an eccentric rod to which the appendage connects.

29. The toy of claim 26 wherein the drive shaft couples the motor to the tail device.

30. The toy of claim 29 further comprising a cam that receives the drive shaft such that rotation of the drive shaft rotates the cam.

31. The toy of claim 30 further comprising a connector piece within the body that connects to the tail device and couples to the cam such that rotation of the cam oscillates the connector piece.

32. The toy of claim 31 wherein the cam defines a groove that receives a shaft of the connector piece.

33. The toy of claim 31 wherein the connector piece connects to a lower piece of the tail device to cause the tail device to oscillate about the second axis as the connector piece oscillates due to rotation of the cam.

34. The toy of claim 26 wherein the drive shaft couples the motor to the neck device.

35. The toy of claim 34 wherein the neck device includes a hinge attached to the body, the hinge defining the third axis.

36. The toy of claim 35 further comprising a follower attached to the neck device and coupled to the drive shaft such that rotation of the drive shaft moves the follower in a periodic pattern and causes the neck device to rotate about the third axis.

37. A toy comprising:

a body at least partly directly contacting a horizontal supporting surface;

a driving device within the body, the driving device including a drive shaft driven by a motor and a rotating device attached to the drive shaft to rotate as the drive shaft rotates;

an appendage at least partly directly contacting the horizontal supporting surface to at least partly support the body, and having a first end that is connected to the rotating device to rotate relative to the body about a first axis that is parallel with the axis of the drive shaft in response to rotation of the rotating device; and a tail device having a piece that interfits with a portion of the rotating device to rotate relative to the body about a second axis that is perpendicular to the first axis in response to rotation of the rotating device.

38. The toy of claim 37 further comprising a neck device coupled to a second rotating device positioned on the drive shaft to rotate about a third axis that is parallel with the first axis.

39. The toy of claim 37 in which the rotation of the appendage and the tail device occurs simultaneously.

40. The toy of claim 37 in which the appendage couples to an eccentric rod on a first surface of the rotating device.

41. The toy of claim 40 further comprising a connector piece within the body that connects to the tail device and couples to the rotating device such that as the rotating device rotates, the connector piece oscillates.

42. The toy of claim 41 wherein the rotating device defines a groove on a second surface of the rotating device, the groove receiving a shaft of the connector piece.

43. The toy of claim 41 wherein the connector piece connects to a lower piece of the tail device to cause the tail device to oscillate about the second axis as the connector piece oscillates due to rotation of the rotating device.

44. The toy of claim 43 wherein the rotation of the tail device has the appearance of a wagging tail.

45. A method of actuating a toy having a body at least partly directly contacting a horizontal surface, a motor within the body, an appendage having a body portion that is coupled to the body and a support portion that at least partly contacts the horizontal supporting surface to at least partly support the body, a tail device coupled to the body, and a neck device coupled to the body, the method comprising:

rotating the body portion of the appendage relative to the body about a first axis including moving the support portion along a non-circular path by actuating the motor without advancing the body along the horizontal supporting surface;

rotating the tail device relative to the body about a second axis that is perpendicular with the first axis by actuating the motor; and rotating the neck device relative to the body about a third axis that is parallel with the first axis by actuating the motor.

46. The toy of claim 1 further comprising a pair of stationary appendages at a portion of the body near the tail device.

47. The toy of claim 1 wherein a part of the appendage body portion is actuated to move along a circular path to cause the appendage support portion to move along the non-circular path.

* * * * *